US008295131B2

(12) United States Patent
Kato et al.

(10) Patent No.: US 8,295,131 B2
(45) Date of Patent: Oct. 23, 2012

(54) CHRONOGRAPH TIMEPIECE

(75) Inventors: Kazuo Kato, Chiba (JP); Akira Takakura, Chiba (JP); Kenji Ogasawara, Chiba (JP); Saburo Manaka, Chiba (JP); Kazumi Sakumoto, Chiba (JP); Hiroshi Shimizu, Chiba (JP); Tomohiro Ihashi, Chiba (JP); Keishi Honmura, Chiba (JP); Takanori Hasegawa, Chiba (JP); Kosuke Yamamoto, Chiba (JP); Eriko Noguchi, Chiba (JP)

(73) Assignee: Seiko Instruments Inc. (JP)

( * ) Notice: Subject to any disclaimer, the term of this patent is extended or adjusted under 35 U.S.C. 154(b) by 285 days.

(21) Appl. No.: 12/803,563

(22) Filed: Jun. 29, 2010

(65) Prior Publication Data

US 2011/0007610 A1 Jan. 13, 2011

(30) Foreign Application Priority Data

Jul. 2, 2009 (JP) ..... 2009-158219

(51) Int. Cl.
*G04F 8/00* (2006.01)
*G04F 10/00* (2006.01)

(52) U.S. Cl. ..... 368/110; 368/112

(58) Field of Classification Search ..... 368/101, 368/106, 110–113
See application file for complete search history.

(56) References Cited

U.S. PATENT DOCUMENTS

| | | | | |
|---|---|---|---|---|
| 6,466,518 | B1 * | 10/2002 | Akahane et al. | 368/64 |
| 6,724,692 | B1 * | 4/2004 | Akahane et al. | 368/204 |
| 7,170,826 | B2 * | 1/2007 | Furukawa et al. | 368/80 |
| 7,215,603 | B2 * | 5/2007 | Koike | 368/223 |
| 2003/0137900 | A1 * | 7/2003 | Akahane et al. | 368/110 |

OTHER PUBLICATIONS

Abstract, publication No. 2005-003493, publication date Jan. 6, 2005.

* cited by examiner

*Primary Examiner* — Vit W Miska
(74) *Attorney, Agent, or Firm* — Adams & Wilks

(57) ABSTRACT

In a chronograph timepiece in which the chronograph hands are electrically rotated by a motor drive pulse and are mechanically zero-restoring-controlled, a basic drive control unit controls a motor so as to drive the chronograph hands when it is detected by a contact portion and a setting releasing detection portion that the setting of the chronograph hands by a setting mechanism has been released.

4 Claims, 7 Drawing Sheets

CHRONOGRAPH TIMEPIECE

BACKGROUND OF THE INVENTION

1. Field of the Invention

The present invention relates to a chronograph timepiece having a time indicating function and a time measuring function.

2. Background Art

Conventionally, there has been developed a chronograph timepiece in which a plurality of driving motors are mounted to respectively drive a plurality of indicator hands to perform time information indication as a basic function, and which is further endowed with a chronograph function to perform time measurement, wherein the driving of each indicator hand is effected electrically by the driving motors; and the zero-restoring of the chronograph hands is effected by a mechanical mechanism such as hearts (See, for example, JP-A-2005-3493).

As in the case of the chronograph timepiece disclosed in JP-A-2005-3493, in a chronograph timepiece in which the chronograph hands are electrically drive-controlled and mechanically zero-restoring-controlled, when, for example, in the reset state, the heart of an arbor (shaft) with a chronograph hand is mechanically maintained in the zero-restored state by a hammer.

Thus, in the above-mentioned chronograph timepiece, when giving a chronograph operation start instruction by depressing a start button, a lever related to zero-restoring is rotated or the like to displace the hammer, thereby permitting the rotation of a chronograph arbor, which is integral with the heart (the releasing of zero-restoring control); then, it is necessary to output a motor rotation drive signal for starting the movement of a chronograph hand in response to the depression of the start button (hand movement control start).

Actually, however, the requisite time for the releasing of zero-restoring control is not strictly fixed; in particular, it is a mechanical control and involves variation in the related components; further, if, in order to minimize the cost, an attempt is made to render the structure as simple as possible, the variation is likely to increase, so that variation in individual products is not always small.

On the other hand, if the releasing of the zero-restoring control has not been completed yet at the point in time when the motor rotation drive signal for the hand movement control start is output, an accurate chronograph operation cannot be executed.

To avoid this problem, conventionally, it has been necessary to design and produce the mechanical system such that the delay in the releasing of zero-restoring control is reliably made shorter than the time measurement cycle of the chronograph timepiece (e.g., 1/100 seconds) taking the variation into consideration. Here, if allowance is to be made for variation, there is nothing for it but to prepare a mechanical system which is more expensive than the one which is actually required in many cases.

In JP-A-2005-3493 also, there is made a proposal regarding the necessity to match the timing of electrical drive control and the timing of mechanical stop control or the like with each other, which necessity is a problem inherent in a system in which such electrical and mechanical controls are combined with each other. More specifically, JP-A-2005-3493 proposes, for example, a technique in which, in order to prevent the mechanical stop control or the like from being started although the rotation drive signal for the motor is still being output, the mechanical structure is modified so as to control the timing with which the zero-restoring control or the like is started. However, this modification proposed in JP-A-2005-3493 neither discloses nor suggests a technique leading to the solution of the above-mentioned problem involved when starting the chronograph operation in a chronograph timepiece in the zero-restored (reset) state.

SUMMARY OF THE INVENTION

It is an aspect of the present invention to provide a chronograph timepiece of the type in which the chronograph hands are electrically drive-controlled and mechanically zero-restoring-controlled, wherein it is possible to prevent the motor for driving the chronograph hands from being electrically driven before the releasing of the mechanical setting with respect to the rotation of the chronograph hands to hinder accurate hand movement.

In accordance with the present invention, there is provided a chronograph timepiece comprising: an operating means giving at least an instruction to start time measurement; a setting mechanism mechanically setting a chronograph hand to a zero-restoring position in a reset state; a releasing means for releasing the setting of the chronograph hand by the setting mechanism in response to the instruction to start time measurement from the operating means; a motor for driving the chronograph hand; and a control means performing control such that the motor drives the chronograph hand in response to the instruction to start time measurement given by the operating means, wherein the chronograph timepiece has a setting releasing detection means for detecting the releasing of the setting of the chronograph hand by the setting mechanism; and the control means controls the motor such that the chronograph hand is driven when the setting releasing detection means detects the releasing of the setting of the chronograph hand.

In accordance with the present invention, there is provided a chronograph timepiece of the type in which the chronograph hands are electrically drive-controlled and mechanically zero-restoring-controlled, wherein it is possible to prevent the motor for driving the chronograph hands from being electrically driven before the releasing of the mechanical setting with respect to the rotation of the chronograph hands to hinder accurate movement of the hands.

DESCRIPTION OF THE PREFERRED EMBODIMENTS

Figure 3:
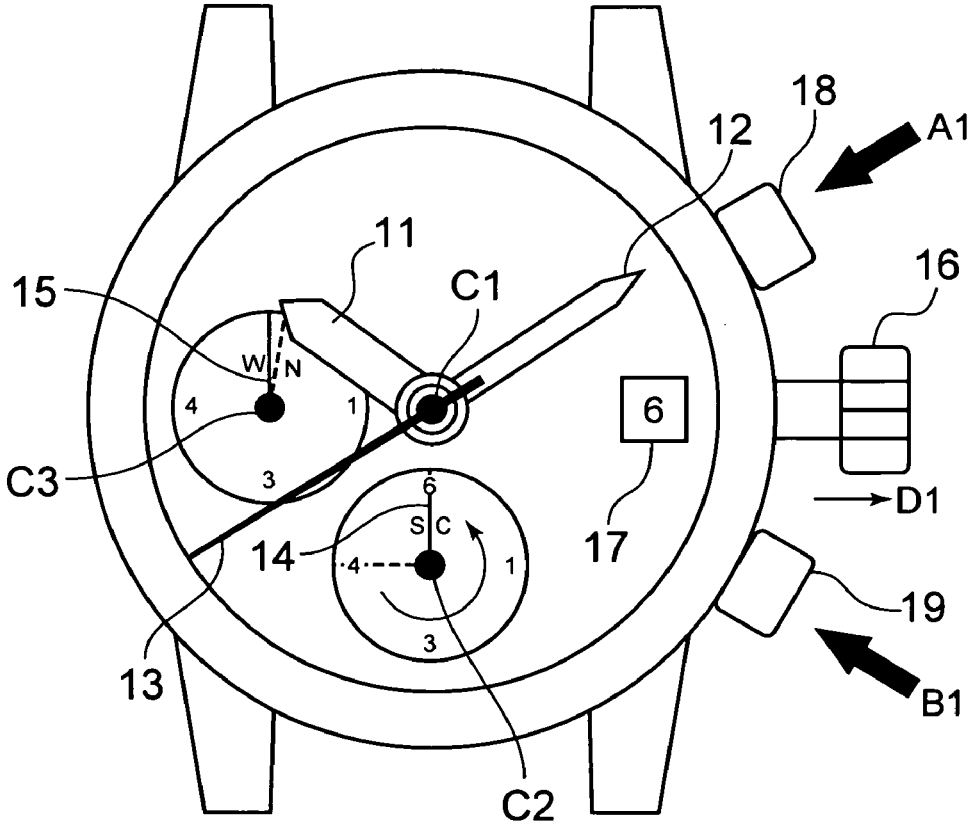
FIG. 3 is a plan view showing the outward appearance of a chronograph timepiece according to an embodiment of the present invention.

As shown in FIG. 3, a chronograph timepiece 1 according to an embodiment of the present invention is in the form of a wristwatch, and is equipped with time hands (an hour hand 11, a minute hand 12, and a second hand 13) rotated around a center axis C1 to indicate the current time, and chronograph hands (a chronograph second hand 14 rotated around a center axis C2 and a chronograph minute hand 15 rotated around a center axis C3).

For example, by turning a winding stem 16 in a state in which it has been drawn out by two steps in a direction D1, it is possible to rotate the time hands 11 through 13; and, by turning the winding stem 16 in a state in which it has been drawn out by one step in the direction D1, it is possible to change a date 17 of a date indicator displayed through a window. The operation of the chronograph timepiece 1 related to normal time display is the same as that of an ordinary electronic timepiece and is well known by those skilled in the art, so that, in the following, a description of the structure and function related to the normal hand movement will be omitted.

In the chronograph timepiece 1, the chronograph hands 14, 15 are electrically drive-controlled by a motor, and zero-restoring-controlled by a mechanical construction.

In the chronograph timepiece 1, by depressing a start/stop button 18 in a direction A1, an instruction to start or stop chronograph operation by the chronograph timepiece 1 is given. More specifically, the start/stopping of the chronograph operation means the start/stopping of the movement of the chronograph hands 14, 15; as described below, in relation to this, the operation of an electric drive system and the retention of electrical positional information on the chronograph hands are effected. In some cases, however, it is not necessary to retain the electrical positional information on the chronograph hands. The start/stop button constitutes an operating means giving at least an instruction to start time measurement.

In the chronograph timepiece 1, by depressing a reset button 19 in a direction B1, there is given an instruction to reset the chronograph operation by the chronograph timepiece 1, that is, to restore the timepiece to the initial state (zero-restoring). More specifically, the resetting of the chronograph operation means forcible restoring (zero-restoring) of the chronograph hands 14, 15 to the initial positions (time indicating positions), the setting of the movement of the chronograph hands 14, 15, and the resetting of the electrical positional information on the chronograph hands.

First, a mechanical structure 5 and operation related to the start, hand movement, and zero-restoring of the chronograph timepiece 1 will be described mainly with reference to FIGS. 2A and 2B. The mechanical structure 5 related to the start, hand movement, and zero-restoring of the chronograph timepiece 1 is also schematically illustrated in the left-hand side portion of the block diagram of FIG. 1.

Apart from a motor (not shown) for normal hand movement (time indicating hand movement), the chronograph timepiece 1 is equipped with a chronograph hand movement motor 35; when rotated and driven, the chronograph hand movement motor 35 moves the chronograph hands 14, 15 via a chronograph hand movement train wheel 36.

The chronograph timepiece 1 is equipped with a chronograph second cam 22 mounted to a chronograph second arbor 21 with the chronograph second hand 14 and a chronograph minute cam 24 mounted to a chronograph minute arbor 23 with the chronograph minute hand 15.

Further, the chronograph timepiece 1 is equipped with a hammer operating first lever (hereinafter also referred to as the "hammer operating lever B") 25, a hammer operating second lever (hereinafter also referred to as the "hammer operating lever A") 26, a hammer 27, and a stop lever 28.

The chronograph second cam 22, the chronograph minute cam 24, and the hammer 27 constitute a setting mechanism, and the hammer operating second lever 26 and the hammer 27 constitute a releasing means. The hammer operating second lever 26 and the hammer 27 also constitute a lever means.

The hammer operating first lever 25 is rotatable between a reference position J1 (indicated by the solid line in FIG. 2B) and a zero-restoring position J2 (indicated by the solid line in FIG. 2A and by the dotted line in FIG. 2B) and is engaged with a spring-like positioning member 29 equipped with a groove with which a positioning pin 25*a* is engaged, thereby undergoing positioning at the reference position J1 or the zero-restoring position J2. An elongated hole 26*a* of the hammer operating second lever 26 is engaged with a pin 25*b* of the hammer operating first lever 25. When the hammer operating first lever 25 is moved from the reference position J1 to the zero-restoring position J2 and position-setting is effected, the hammer operating second lever 26 is moved from the reference position K1 (indicated by the solid line in FIG. 2B) to the zero-restoring position K2 (indicated by the solid line in FIG. 2A and by the dotted line in FIG. 2B).

On the other hand, when the hammer operating second lever 26 is moved from the zero-restoring position K2 to the reference position K1 and position-setting is effected, the hammer operating first lever 25 is moved from the zero-restoring position J2 to the reference position J1 and positioning is effected.

Figure 2A:
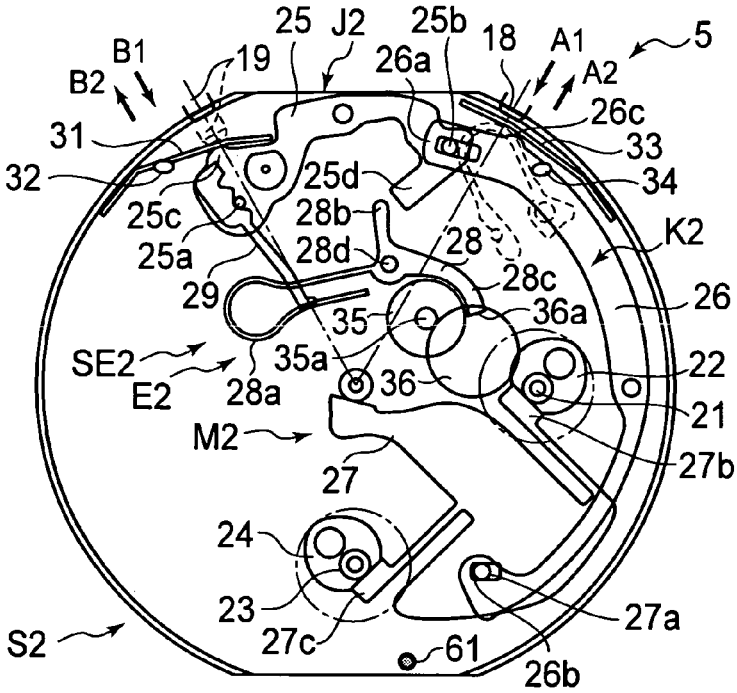
FIGS. 2A and 2B are plan views schematically illustrating the mechanical construction of a chronograph timepiece according to an embodiment of the present invention.
Figure 2B:
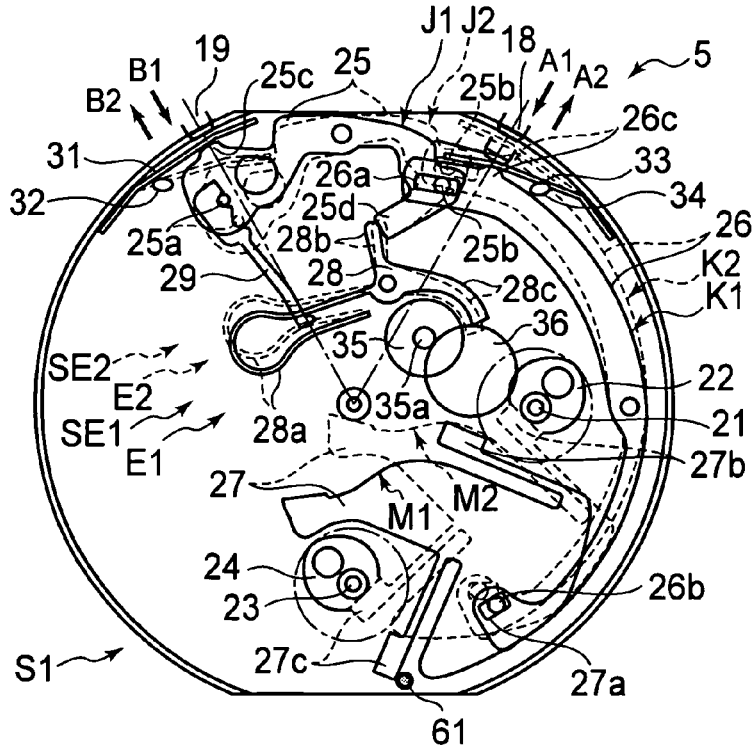

An elongated hole 27*a* of the hammer 27 is engaged with a pin 26*b* of the hammer operating second lever 26, and, in correspondence with the position-setting of the hammer operating second lever 26 to the reference position K1 or the zero-restoring position K2, positioning is effected thereon at the reference position M1 (indicated by the solid line in FIG. 2B) or at the zero-restoring position M2 (indicated by the solid line in FIG. 2A and by the dotted line in FIG. 2B). When set at the reference position M1, the hammer 27 abuts a contact portion 61 for setting releasing detection which is fixed at a predetermined position.

When the hammer 27 is set at the zero-restoring position M2, a second hammer portion 27*b* of the hammer 27 strikes a chronograph second cam 22 to zero-restore the chronograph second hand 14 to the initial position and, at the same time, a minute hammer portion 27*c* thereof strikes a chronograph minute cam 24 to zero-restore the chronograph minute hand 15 to the initial position. Further, at the zero-restoring position M2, the hammer 27 is spaced apart from the contact portion 61 for setting releasing detection.

In this way, the hammer 27 is situated such that, at the reference position M1, it is in contact with the contact portion 61, and that, at the zero-restoring position M2, it is not in contact with the contact portion 61. The hammer 27 and the contact portion 61 are formed of a conductive metal, and the hammer 27 is connected to a power source VDD; as described below, a setting releasing detection unit 62 electrically detects whether the hammer 27 is in contact with the contact portion 61 or not, thereby detecting whether or not the setting of the chronograph hands has been released.

The stop lever 28 is equipped with a spring portion 28*a*, an engagement arm portion 28*b*, and a lock arm portion 28*c*, and is rotatable around a pin 28*d* between a correction control position or setting position E2 at the time of zero-restoring (indicated by the solid line in FIG. 2A and by the dotted line in FIG. 2B) and a correction control cancelling position or setting releasing position E1 (indicated by the solid line in FIG. 2B). In a state SE2 in which the stop lever 28 is at the setting position E2, the lock arm portion 28*c* of the stop lever 28 is engaged with one wheel 36*a* of a chronograph hand movement train wheel 36 leading to a rotor cogwheel 35*a* of the chronograph hand movement motor 35 to thereby effect setting on the rotation of the train wheel 36; and in a state SE1 in which the stop lever 28 is at the setting releasing position E1, it is separated from the wheel 36*a* of the train wheel 36 and permits rotation of the rotor cogwheel 35*a* of the motor 35 and of the train wheel 36.

When the hammer operating first lever 25 is rotated from the zero-restoring position J2 to the reference position J1, the engagement arm portion 28*b* of the stop lever 28, whose spring portion 28*a* is under a biasing force toward the setting position E2, is engaged with the arm portion 25*d* of the hammer operating first lever 25, and the stop lever 28 is rotated and displaced from the setting position E2 at the time of zero-restoring to the setting releasing position E1. On the other hand, when the hammer operating first lever 25 is moved from the reference position J1 to the zero-restoring position J2, the engagement of the arm portion 25*d* of the hammer operating first lever 25 with the engagement arm portion 28*b* is released, so that the stop lever 28 is restored from the setting releasing position E1 to the setting position E2 by the resilient force of the spring portion 28*a*.

When the start/stop button 18 is depressed in the direction A1, with the chronograph timepiece 1 being in the zero-restored (reset) state S2 as shown in FIG. 2A, a protrusion 26*c* of the hammer operating second lever 26 is depressed in the direction A1 and is displaced from the position K2 to the position K1, and the hammer operating first lever 25 is displaced from the position J2 to the position J1, with the hammer 27 being displaced from the position M2 to the position M1. As a result, the rotation setting (zero-restoring control) of the hearts 22, 24 and the chronograph hands 14, 15 by hammer portions 27*b*, 27*c* is released. Further, in response to the rotation of the hammer operating first lever 25 from the position J2 to the position J1, the stop lever 28 whose arm portion 28*b* is engaged with the arm portion 25*d* of the hammer operating first lever 25 is rotated from the setting position E2 to the setting releasing position E1, and the lock arm portion 28*c* of the stop lever 28 is separated from the chronograph train wheel 36 to thereby release the rotation setting (stop control) of the train wheel 36. As a result, the mechanical control mechanism 5 is restored to the state S1, and the chronograph hands 14, 15 become rotatable.

Further, through the displacement of the hammer 27 from the position M2 to the position M1, the hammer portion 27*c* of the hammer 27 abuts the contact portion 61.

On the other hand, when the reset button 19 is depressed in the direction B1, with the chronograph timepiece 1 being in the start state or hand movement state S1 as shown in FIG. 2B, the protrusion 25*c* of the hammer operating first lever 25 is depressed in the direction B1, and the hammer operating first lever 25 is displaced from the position J1 to the position J2. When the hammer operating first lever 25 is displaced from the position J1 to the position J2, the hammer operating second lever 26 engaged with the lever 25 is moved from the position K1 to the position K2 on the one hand, and the hammer 27 engaged with the lever 26 moves from the position M1 to the position M2, with the second hammer 27*b* and the minute hammer 27*c* striking the second heart 22 and the minute heart 24 to zero-restore the chronograph second hand 14 and the chronograph minute hand 15; on the other hand, the lock of the arm portion 25*d* with respect to the stop lever 28 is released, and the stop lever 28 is rotated from the position E1 to the position E2, with the arm portion 28*c* thereof being engaged with the chronograph train wheel 36 to effect setting on the train wheel 36.

Further, through the displacement of the hammer 27 from the position M1 to the position M2, the hammer portion 27*c* of the hammer 27 is separated from the contact portion 61.

Regarding the mechanical structure 5 of the chronograph timepiece 1 as shown in FIGS. 2A and 2B, the electrical aspect thereof will be described as follows.

When the start/stop button 18 is depressed in the direction A1, with the chronograph timepiece 1 being in the reset state S2 as shown in FIG. 2A, the start/switch button 18 presses a start/stop switch spring 33 exerting a biasing force in the direction A2 in the vicinity of the depth end thereof to close a contact portion 34, generating a start signal Pa (FIG. 1) via the contact portion 34. When the start/stop button 18 is depressed in the direction A1, with the chronograph timepiece 1 being in the start state S1 as shown in FIG. 2B, the start/stop button 18 presses the start/stop switch spring 33 to close the contact portion 34, generating a stop signal Pb (FIG. 1) via the contact portion 34.

On the other hand, when the reset button 19 is depressed in the direction B1, with the chronograph timepiece 1 being in the start state S1 (or the stop state) as shown in FIG. 2B, the reset button 19 presses a reset switch spring 31 exerting a biasing force in the direction B2 in the vicinity of the depth end thereof to close the contact portion 32, generating a reset signal Qa (FIG. 1) via the contact portion 32.

Of the above operations, in the following, a more detailed description will be given mainly of the start and progress of the start operation when the start/stop button 18 is depressed in the direction A1 in the zero-restored state S2 of FIG. 2A.

That is, as the start/stop button 18 is depressed in the direction A1, there is output, on the one hand, an electrical drive start signal Pa via the switch contact 34, whereby the motor 35 is rotated and driven; on the other hand, through the rotation of the hammer 27 with the rotation of the hammer operating second lever 26, the mechanical zero-restoring control state is released and, at the same time, through the rotation of the stop lever 28 with the rotation of the hammer operating second lever 26 and of the hammer operating first lever 25, the lock (stop control state) of the train wheel 36 is released, and the hand movement is mechanically permitted (i.e., the mechanical setting is released).

Further, the hammer 27 is rotated and displaced from the position M2 to the position M1, whereby the hammer portion 27*c* of the hammer 27 is retained in the state in which it is in contact with the contact portion 61.

Here, for the chronograph timepiece 1 to properly operate to accurately perform time measurement, it is necessary for the motor 35 to be rotated and driven after the completion of the releasing of the mechanical setting. In the chronograph timepiece 1, electrical driving is reliably effected after the completion of the releasing of the mechanical setting while avoiding a complication of the structure and an increase in the cost entailed. In the following, a detailed description will be given centering on this point.

Figure 1:
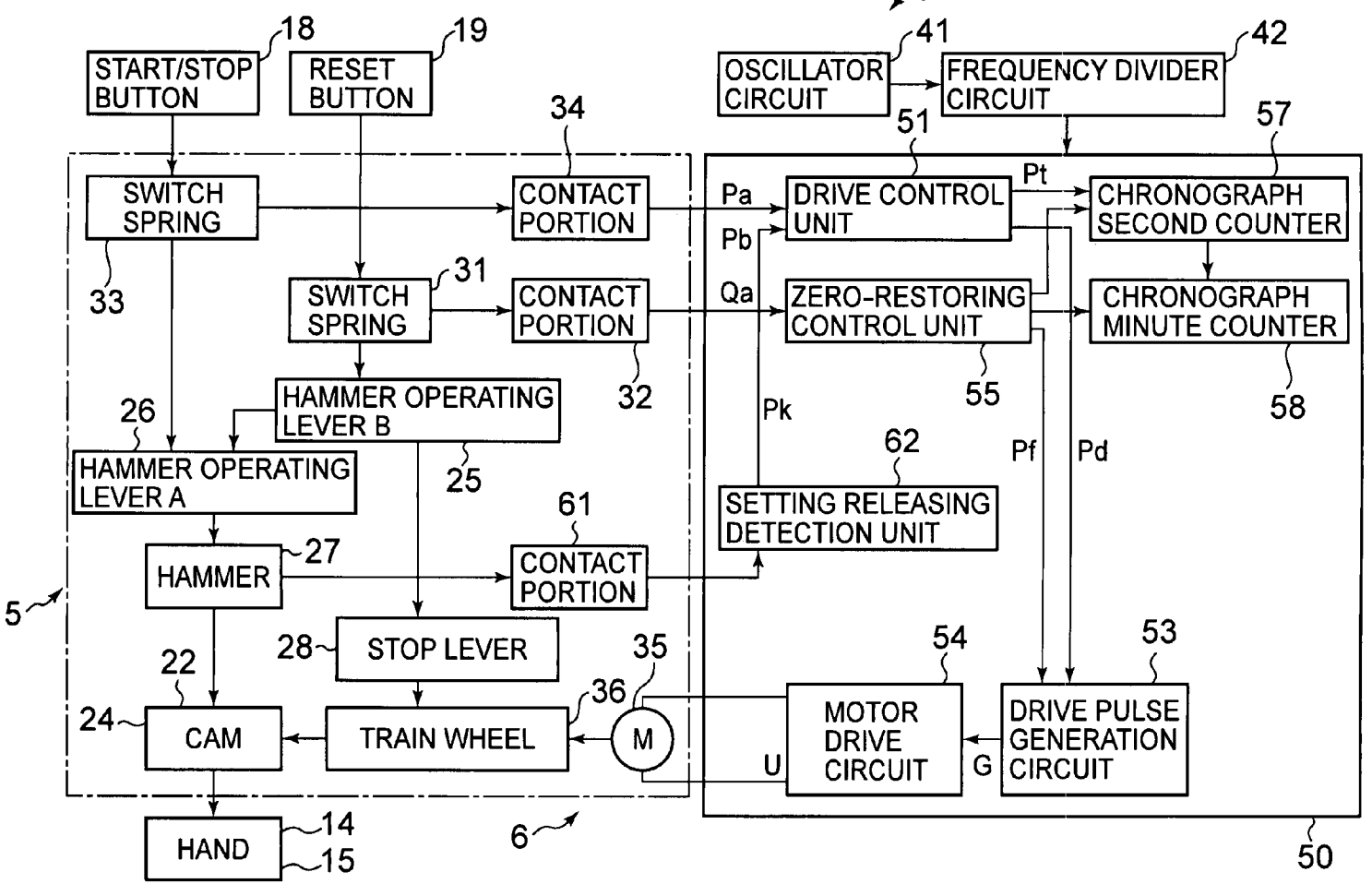
FIG. 1 is a block diagram illustrating a chronograph timepiece according to an embodiment of the present invention.

Next, the outline of the electric drive mechanism 6 of the chronograph timepiece 1 will be described mainly with reference to the block diagram of FIG. 1, with the mechanical structure 5 of FIG. 2 also being referred to.

The rotation of the chronograph hand movement motor 35 of the chronograph timepiece 1 is controlled by a drive control integrated circuit 50 of the chronograph hand movement motor 35 which is drive-controlled on the basis of clock pulses provided via an oscillator circuit 41 and a frequency divider circuit 42.

The motor drive control integrated circuit 50 has a basic drive control unit 51, a drive pulse generation circuit 53, a motor drive circuit 54, a zero-restoring control unit 55, and a setting releasing detection unit 62. Here, the driving means of the chronograph hand movement motor 35 consists of a motor drive circuit 54, and the drive control means of the chronograph hand movement motor 35 has the drive pulse generation circuit 53, the basic drive control unit 51, the zero-restoring control unit 55, and the setting releasing detection unit 62. The basic drive control unit 51, the drive pulse generation unit 53, and the motor drive circuit 54 constitute a control means. The motor drive control integrated circuit 50 further has a chronograph second counter 57 counting chronograph seconds and retaining the chronograph second information, and a chronograph minute counter 58 counting chronograph minutes and retaining the chronograph minute information. There may be further provided a chronograph hour counter counting chronograph hours and retaining the chronograph hour information.

The basic drive control unit 51 receives a start signal or operation signal Pa provided via the contact portion 34 in response to the depression of the start/stop button 18 when the chronograph timepiece 1 is in the zero-restored (reset) state S2. In synchronization with the depression of the start/stop button 18, the hammer 27 abuts the contact portion 61, and, when the hammer 27 abuts the contact portion 61, the setting releasing detection unit 62 detects this, and outputs a high-level setting releasing detection signal Pk to the basic drive control unit 51.

Upon receiving the start signal or operation signal Pa, the basic drive control unit 51 outputs, after a short period of time for preventing chattering, a chronograph time measurement control signal Pt to start time measurement; further, upon receiving the setting releasing detection signal Pk, it issues a drive control signal Pd. In the following, unless otherwise specified with reference to FIG. 4, etc. that will be referred to below, it will be assumed that the point in time when the setting releasing detection signal Pk is received and the point in time when the drive control signal Pd is transmitted are substantially identical with each other. The setting releasing detection signal Pk and the drive control signal Pd are signals that are maintained at high level during the period in which the chronograph operation is conducted.

Further, upon receiving a stop signal Pb provided via the contact portion 34 in response to the depression of the start/stop button 18 when the chronograph timepiece 1 is in the start state S1 (or upon the stopping of the transmission of the start signal or operation signal Pa from the contact portion 34), the basic drive control unit 51 stops the transmission of the drive control signal Pd.

A time measurement control signal Pt from the basic drive control unit 51 is imparted to the chronograph second counter 57, and, while the time measurement control signal Pt is maintained at high level, the chronograph second counter 57 receives clock pulses supplied from the frequency divider circuit 42 and counts chronograph seconds; and, using the point in time t1 when the chronograph time measurement is started based on the time measurement control signal Pt as the start point, it emits a chronograph timing pulse Ph for each cycle T from that point in time. The cycle T of the pulses Ph corresponds to the time measurement accuracy of the chronograph timepiece 1; it is, for example, 1/100 sec. (i.e., 10 ms).

Upon receiving the drive control signal Pd, the drive pulse generation circuit 53 imparts a main drive pulse G of a predetermined pulse width to the motor drive circuit 54. The motor drive circuit 54 imparts a motor drive pulse U of a drive energy corresponding to the main drive pulse G to the chronograph hand movement motor 35 to rotate and drive the motor 35.

On the other hand, when the basic drive control unit 51 receives the stop signal Pb, the drive control unit 51 stops the emission of the drive control signal Pd (if so desired, a drive stop signal Pf may be provided), the emission of the drive pulse G from the drive pulse generation circuit 53 is stopped and the emission of the motor drive pulses U by the motor drive circuit 54 is stopped; and the rotation of the chronograph hand movement motor 35 is stopped, and the rotation of the rotor or output shaft of the motor 35 is stopped, with the movement of the chronograph hands 14, 15 via the chronograph hand movement train wheel 36 being stopped.

When the switch spring 31 is pushed down through the depression of the reset button 19 to close the contact portion 32, a reset signal Qa is imparted to the zero-restoring control unit 55. Upon receiving the reset signal Qa from the contact portion 32, the zero-restoring control unit 55 imparts the drive stop signal Pf to the drive pulse generation circuit 53. As a result, the drive pulse generation circuit 53 stops the generation of the drive pulse G, stopping the emission of the motor drive pulse U by the motor drive circuit 54. Thus, the rotation of the chronograph hand movement motor 35 is stopped, and the movement of the chronograph hands 14, 15 is stopped. Upon receiving the reset signal Qa, the zero-restoring control unit 55 resets the contents of the chronograph second counter 57 and of the chronograph minute counter 58 to zero.

Next, regarding the chronograph timepiece 1 of FIG. 1, mainly the setting releasing detection operation of the setting releasing detection unit 62 will be specifically described with reference to the time chart of FIG. 4.

Suppose, with the chronograph timepiece 1 being in the reset state S2, the start/stop button 18 is depressed in the direction A1 at a point in time t0. As a result of the depression of the start/stop button 18, the contact portion 34 is closed, and the start signal Pa is output via the contact portion 34. The start signal Pa is continued until a point in time tx to which the closing of the contact portion 34 as a result of the depression of the start/stop button 18 is continued.

When the start signal Pa is imparted to the basic drive control unit 51, the basic drive control unit 51 starts chronograph time measurement operation at the point in time t1 after a short period of time necessary for avoiding the influence of chattering.

On the other hand, in synchronization with the depression of the start/stop button 18, the hammer 27 abuts the contact portion 61, and, at a point in time t2, the setting releasing detection unit 62 detects that the hammer 27 has abutted the contact portion 61, outputting the high-level setting releasing detection signal Pk to the basic drive control unit 51.

Upon receiving both the start signal Pa and the setting releasing detection signal Pk, the basic drive control unit 51 outputs the drive control signal Pd to the drive pulse generation circuit 53 at the point in time t3 when both the signals Pa, Pk are received. In response to the drive control signal Pd, the drive pulse generation circuit 53 generates the main drive pulse G to generate the motor drive pulse U in the motor drive circuit 54.

That is, as indicated at the bottom as U (prior art), in the prior art, in which the setting releasing detection is not effected, the motor drive pulse U (prior art) is emitted from the point in time t1 when chronograph time measurement operation is started to the point in time t2 after the cycle T, whereas, in the chronograph timepiece 1, the basic drive control unit 51 controls the drive pulse generation circuit 53 such that the motor drive pulse U is emitted from the motor drive circuit 54 at the point in time t3 when the setting releasing is detected, which is later than the point in time t2.

Figure 4:
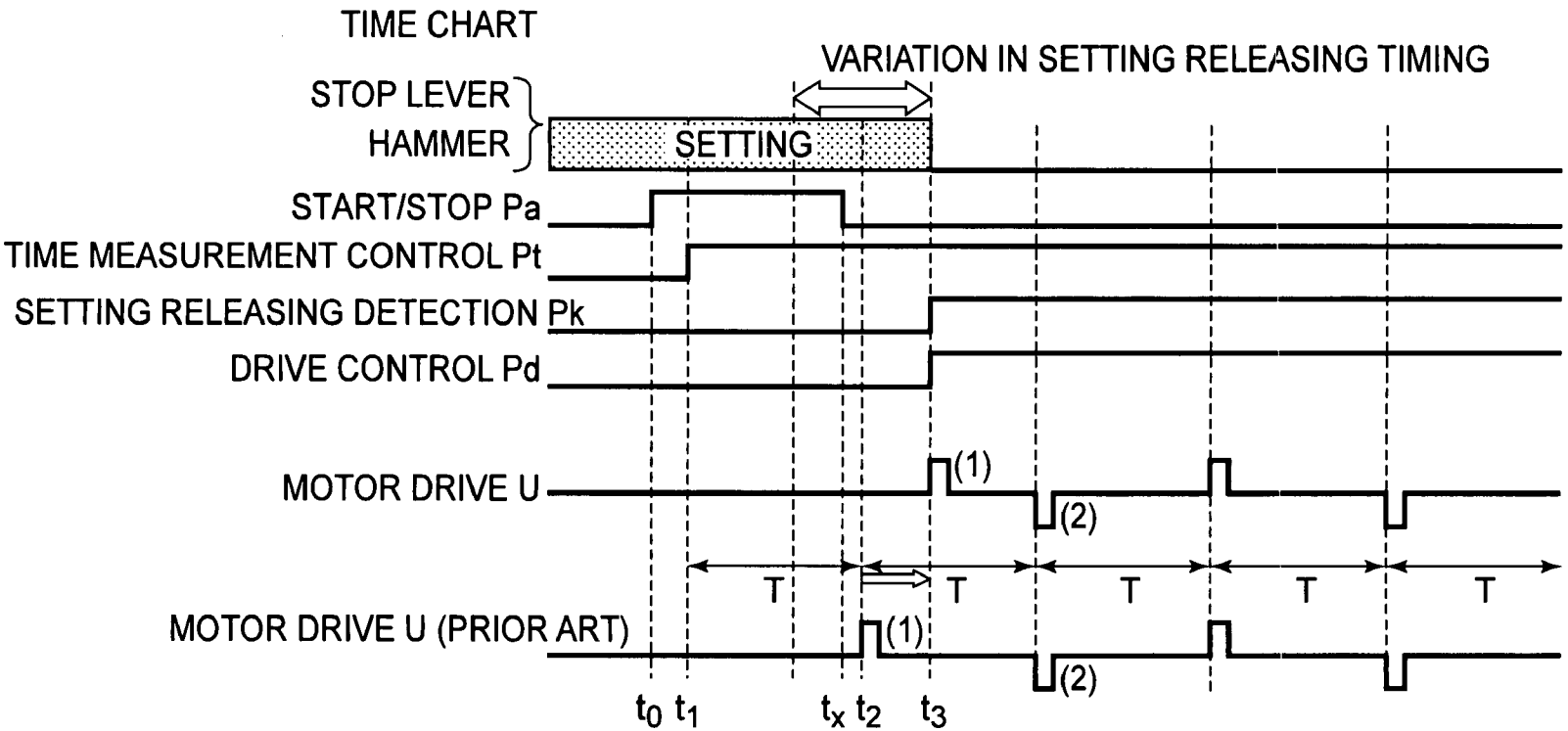
FIG. 4 is a timing chart for a chronograph timepiece according to an embodiment of the present invention.

As indicated at the top of FIG. 4, the stop lever 28 effects setting on the train wheel 36 until a point in time when a predetermined period of time has elapsed; after the elapse of a predetermined period of time after the point in time t0, when the start/stop button 18 is depressed and the contact 34 is closed, causing the start signal Pa to attain high level, and after the setting releasing is effected on the stop lever 28 simultaneously with the setting releasing of the hammer 27, the motor drive pulse U is output.

Thus, when the motor drive pulse U is output from the motor drive circuit 54, the motor 35 is reliably rotated by the motor drive pulse U, and the chronograph hands 14, 15 can be reliably moved.

Figure 5:
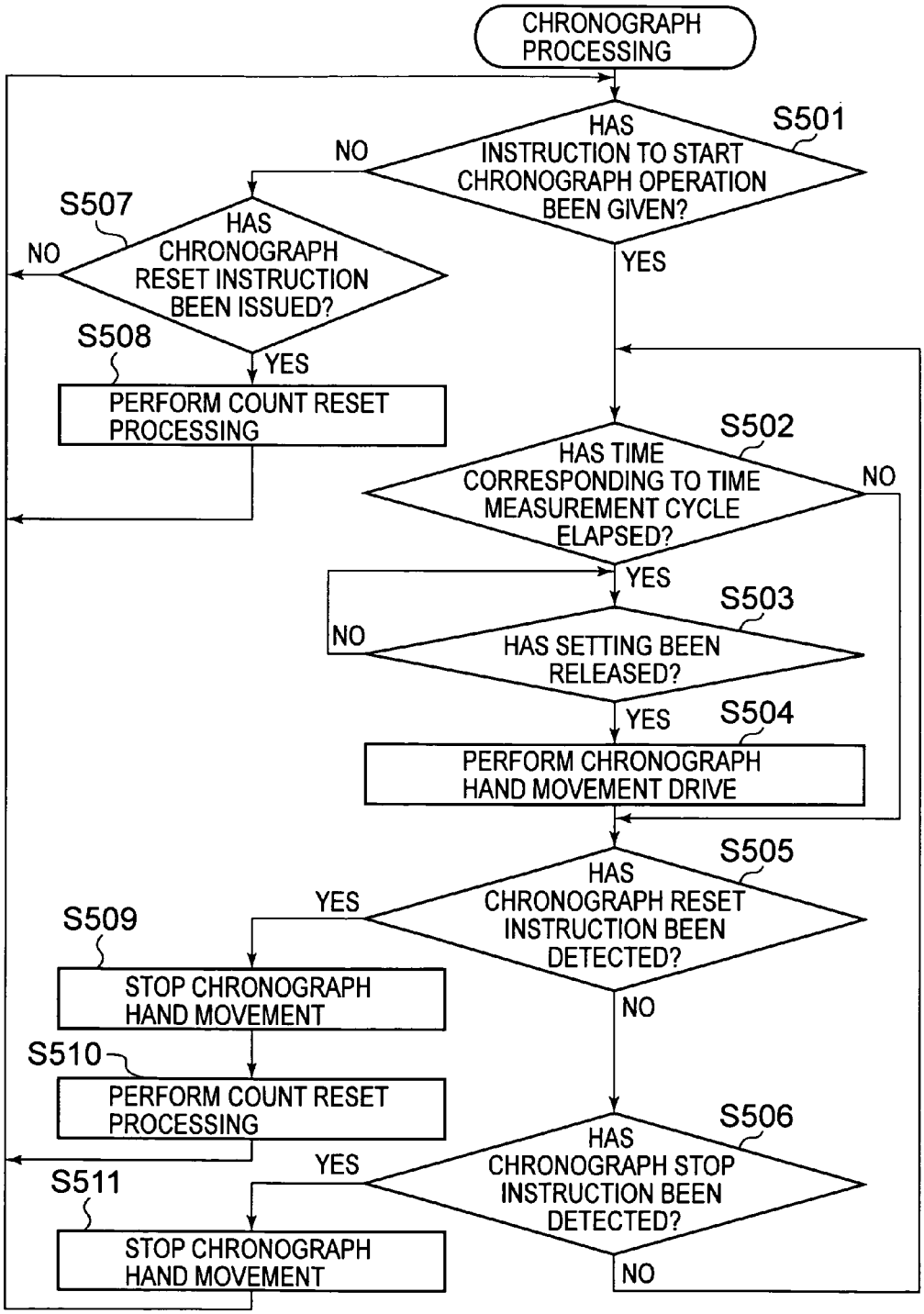
FIG. 5 is a flowchart for an embodiment of the present invention.

Next, the operation of the chronograph timepiece 1, constructed as described above, will be illustrated mainly with reference to the flowchart of FIG. 5 while also referring to FIGS. 1 through 4. This flowchart mainly shows the operation of the basic drive control unit 51 and the setting releasing detection unit 62 of the integrated circuit 50 of the chronograph timepiece 1 of FIG. 1 as a program procedure flow corresponding to the operation.

In the chronograph timepiece 1, in the first processing step S501, it is checked whether or not a chronograph operation start instruction has been given. The start check step S501 corresponds to the checking as to whether or not the contact portion 34 has been closed for contact through the displacement of the switch spring 33 in the direction A1 by the depression of the start/stop button 18 in the direction A1 to impart the operation signal or start signal Pa to the basic drive control unit 51 of the integrated circuit 50 from the contact portion 34.

In the case in which no start signal Pa has been output, it is checked whether or not an instruction for resetting (zero-restoring) has been issued in step S507. The reset check step S507 corresponds to the checking as to whether or not the reset (zero-restoring) button 19 has been depressed in the direction B1 to displace the switch spring 31 in the direction B1 to close the contact portion 32 to cause the reset signal Qa to be imparted to the reset control unit 55 of the integrated circuit 50 from the contact portion 32. In the case in which no reset signal Qa has been output, the procedure returns to the first processing step S501. When the reset signal Qa has been output, there is effected in step S508 a count reset processing in which the contents of the chronograph second counter 57 and of the chronograph minute counter 58 are restored to zero, and then the procedure returns to the first processing step S501.

When, in the start check step S501, start instruction of chronograph operation (start signal Pa) is confirmed, it is checked in step S502 as to whether a period of time corresponding to the time measurement cycle T (which is, in this example, for instance, 1/100 sec, i.e., 10 ms) of the chronograph operation has elapsed. When the time measurement cycle T is attained, the procedure advances to step S503. This corresponds to the fact that the time from the point in time t1 for the chronograph operation start onward is measured by the chronograph second counter 57, and that when the time corresponding to the time measurement cycle T is attained, a timing pulse Ph is emitted.

When the time T has elapsed, it is checked in step S503 as to whether or not the setting of the chronograph hands 14, 15 by the hammer 27 has been released. This corresponds to the detection by the setting releasing detection unit 62 as to whether or not the setting has been released based on the signal from the contact portion 61.

When it is confirmed in step S503 that the setting has been released, the setting releasing detection signal Pk undergoing high-level variation at the point in time t3 is output from the setting releasing detection unit 62 in step S504; upon receiving the start signal Pa and the setting releasing detection signal Pk, the basic drive control unit 51 outputs the drive control signal Pd to the drive pulse generation circuit 53 at the point in time t3, and the drive pulse G and the motor drive pulse U are successively output from the drive pulse generation circuit 53 and the motor drive circuit 54 to drive the motor 35. In this way, after the setting of the chronograph hands 14, 15 has been released, driving is effected by the motor 35, so that it is possible to reliably move and drive the chronograph hands 14, 15.

When each hand movement drive has been effected in step S504, it is checked in step S505 as to whether or not a chronograph resetting instruction (reset signal Qa) has been issued. The judgment processing itself in step S505 is the same as that in step S507.

In the case in which no resetting instruction has been issued, it is checked in step S506 as to whether the chronograph stopping instruction (stop signal Pb) has been issued or not.

In the case in which no stopping instruction has been issued, the procedure returns to step S502 to repeat the above procedures.

When, in step S502, the time measurement cycle has not been attained, steps S505 and S506 are repeatedly executed before returning to step S502 until the time measurement cycle is attained.

Here, after the start step S501, until the stopping instruction (stop signal Pb) is issued in step S506, the chronograph hands 14, 15 are moved in steps S502, S503, and S504, and then steps S506 and S507 are executed with the answer "No"; by repeating this, there is conducted the normal chronograph hand movement operation, in which the chronograph hands 14, 15 are moved.

On the other hand, when it is detected by the drive control unit 51 that the stopping instruction has been issued in step S506 (the emission of the stop signal Pb from the contact portion 34), the procedure advances to step S511; in step S511, the stop processing for stopping the movement of the chronograph hands 14, 15 (the stopping of the transmission of the control signal Pd to the drive pulse generation circuit 53 or the transmission of the drive stop signal Pf) is effected, and then the procedure returns to step S501.

When it is detected in step S505 that the resetting instruction has been issued (the emission of the reset signal Qa from the contact portion 32), the zero-restoring control unit 55 enters into the chronograph hand movement stopping step S509 which is similar to step S511 in that the drive stop signal Pf is imparted to the drive pulse generation circuit 53; in the hand movement stopping step S509, there is conducted a stopping processing for stopping the movement of the chronograph hands 14, 15. Next, in the count resetting step S510, which is similar to step S508, the zero-restoring control unit 55 performs a count resetting processing for restoring the contents of the chronograph second counter 57 and of the chronograph minute counter 58 to zero, and then the procedure returns to the first processing step S501.

As described above, in a chronograph timepiece of the type in which the chronograph hands are electrically drive-controlled and mechanically zero-restoring-controlled, it is possible to prevent the chronograph hand drive motor from being electrically driven before the mechanical setting with respect to the rotation of the chronograph hands has been released to thereby hinder accurate hand movement. Further, since the hand movement drive pulse and the setting of the mechanism do not overlap each other, it is possible to prevent a hand movement delay, and to reduce the limitations regarding the mechanism, thus increasing the degree of freedom in design. Further, the mechanism needs not control the maximum time until the hammer and the stop lever are securely released in order to prevent the hand movement drive pulse immediately after the chronograph operation start from overlapping the setting of the mechanism.

Figure 6A:
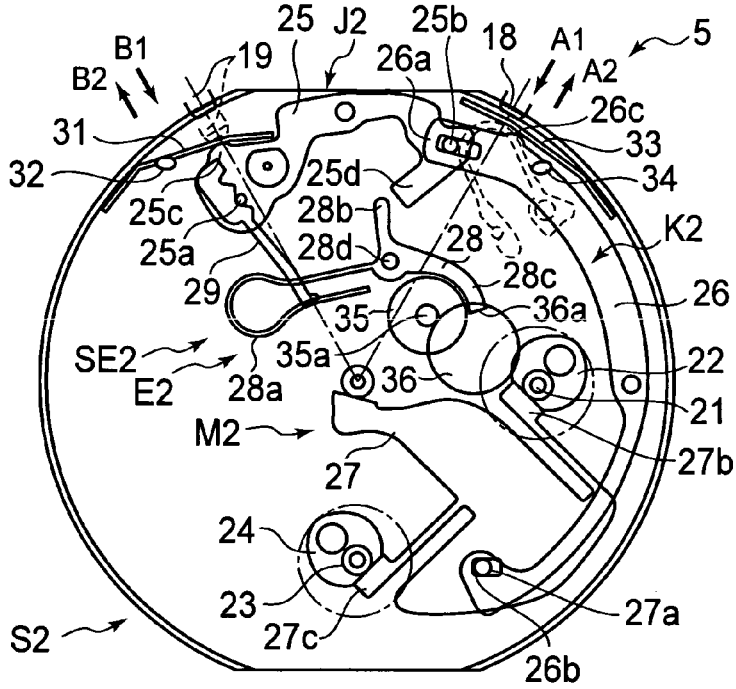
FIGS. 6A and 6B are plan views schematically illustrating the mechanical construction of chronograph mechanism of a chronograph timepiece according to another embodiment of the present invention.
Figure 6B:
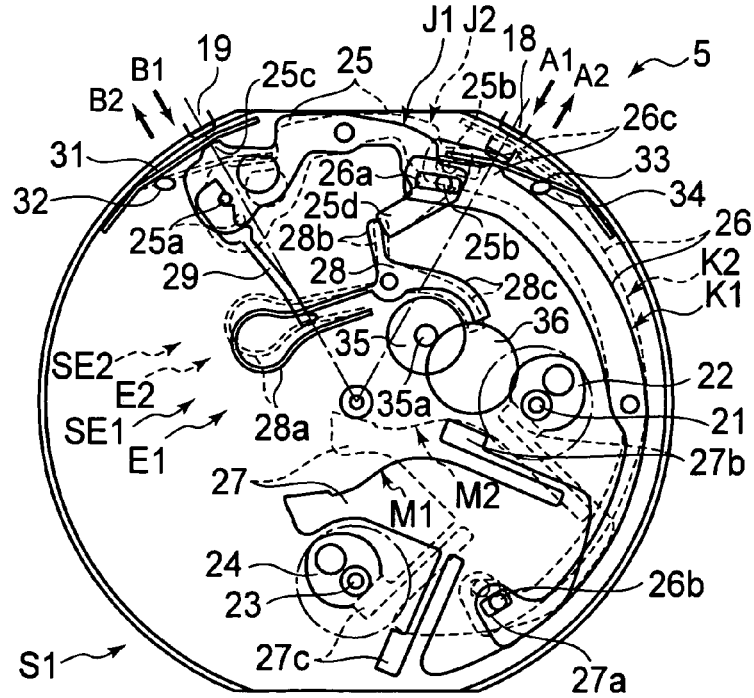
Figure 7:
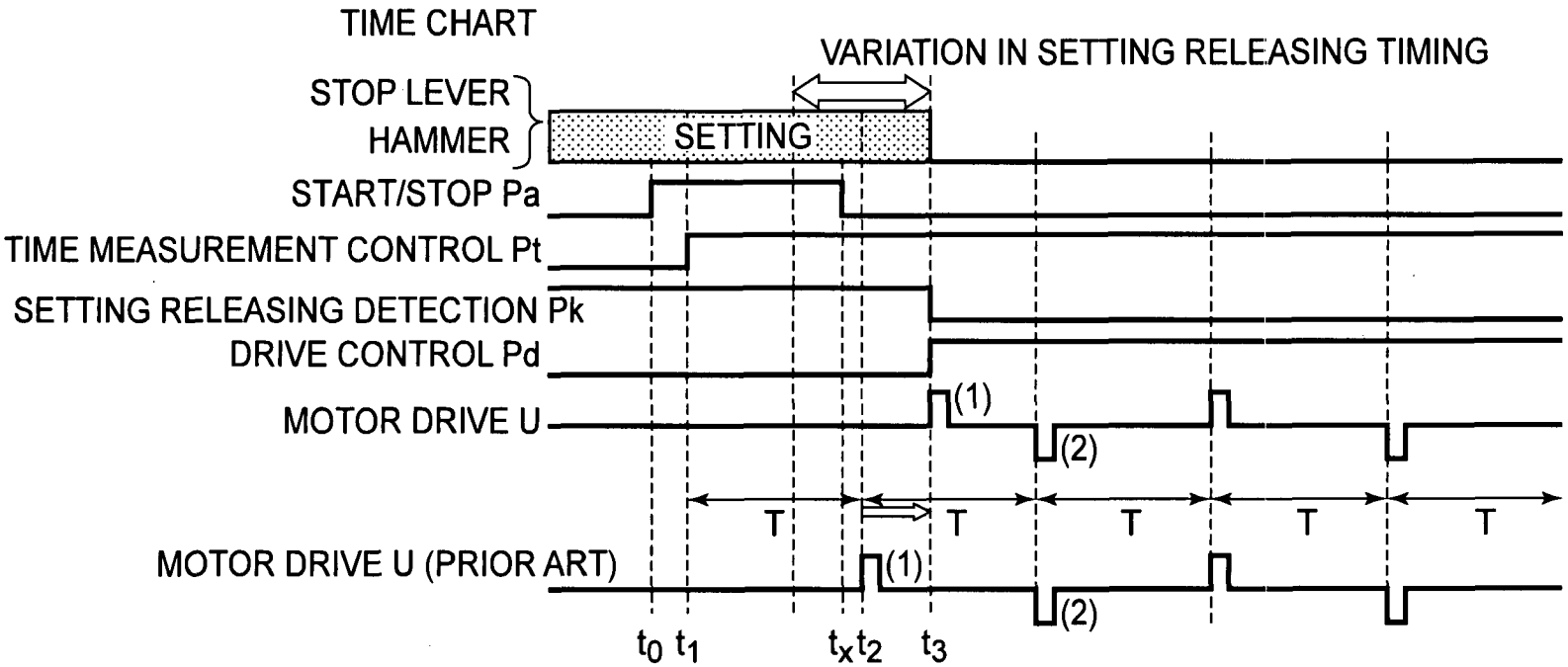
FIG. 7 is a timing chart for a chronograph timepiece according to an embodiment of the present invention.

FIGS. 6A and 6B are plan views schematically showing the mechanical construction of the chronograph mechanism of a chronograph timepiece according to another embodiment of the present invention, and FIG. 7 is a timing chart for the chronograph timepiece of the embodiment of FIGS. 6A and 6B. In both drawings, the portions that are the same as those of FIGS. 1 through 5 are indicated by the same reference numerals. The block diagram of FIG. 1, the outward appearance view of FIG. 3, and the flowchart of FIG. 5 are the same as those of the other embodiment.

In the above embodiment, the contact portion 61 is provided in order to detect setting releasing of the chronograph hands, and the setting releasing is judged to have been effected through detection of the change of the hammer 27 and the contact portion 61 from the non-contact state to the contact state, whereas, in the other embodiment, no special contact portion is provided, and part of the chronograph second cam 22 and the chronograph minute cam 24 formed of a conductive metal also serves as the contact portion, with the setting releasing being judged to have been effected through detection of the change from a contact state to a non-contact state of the hammer 27, the chronograph second cam 22, and the chronograph minute cam 24, which are formed of a conductive metal. The contact portion where the chronograph second cam 22 and the chronograph minute cam 24 abut the hammer 27 is indicated as the contact portion 61 of FIG. 1.

As shown in FIG. 6A, in the state in which the chronograph hands 14, 15 are set, the second hammer portion 27*b* and the minute hammer portion 27*c* of the hammer 27 respectively abut the chronograph second cam 22 and the chronograph minute cam 24, setting the chronograph second hand 14 and the chronograph minute hand 15. The hammer 27 is connected to a power source VDD and, in this state, the hammer 27 is held in contact with the chronograph second cam 22 and the chronograph minute cam 24; and, as shown in FIG. 7, a high-level setting releasing detection signal Pk is output from the setting releasing detection unit 62.

When the start/stop button 18 is depressed, and the state of FIG. 6B is attained, the second hammer portion 27*b* and the minute hammer portion 27*c* of the hammer 27 are respectively separated from the chronograph second cam 22 and the chronograph minute cam 24 to be brought into a non-contact state, and the setting of the chronograph second hand 14 and the chronograph minute hand 15 is released. In this state, the hammer 27 is spaced apart from the chronograph second cam 22 and the chronograph minute cam 24, and, as shown in FIG. 7, a low-level setting releasing detection signal Pk is output from the setting releasing detection unit 62.

Upon receiving both the start signal Pa and the low-level setting releasing signal Pk, the basic drive control unit 51 outputs a drive control signal Pd to the drive pulse generation circuit 53. Thereafter, the drive-control is effected on the chronograph hands 14, 15 in the same manner as in the above-described embodiment.

Also in the other embodiment, as in the above-described embodiment, it is possible, for example, to prevent the chronograph hand driving motor from being electrically driven before the mechanical setting of the rotation of the chronograph hands has been released to hinder accurate hand movement.

While in the above-described embodiments, the chronograph second hand is arranged on the 6 o'clock side, and the chronograph minute hand is arranged on the 9 o'clock side, the present invention is also applicable to a center chronograph using the hand 13 as the chronograph second hand.

The present invention is applicable to various types of chronograph timepiece in which the time hands and the chronograph hands are electrically driven by a motor and in which, in the reset state, setting is effected by a mechanical mechanism so that the chronograph hands may not move, with the chronograph hands being driven after the releasing of the setting by the mechanical mechanism.

What is claimed is:

1. A chronograph timepiece comprising: an operating means giving at least an instruction to start time measurement; a setting mechanism mechanically setting a chronograph hand to a zero-restoring position in a reset state; a releasing means for releasing the setting of the chronograph hand by the setting mechanism in response to the instruction to start time measurement from the operating means; a motor for driving the chronograph hand; and a control means performing control such that the motor drives the chronograph hand in response to the instruction to start time measurement given by the operating means, wherein the chronograph timepiece has a setting releasing detection means for detecting the releasing of the setting of the chronograph hand by the setting mechanism; and the control means controls the motor such that the chronograph hand is driven when the setting releasing detection means detects the releasing of the setting of the chronograph hand.

2. A chronograph timepiece according to claim 1, wherein the operating means is a start/stop button for giving an instruction to start and stop time measurement operation;

the releasing means has a lever means displaced in response to the operation to give a time measurement start instruction by the start/stop button in the reset state to release the setting of the chronograph hand by the setting mechanism; and the setting releasing detection means is formed by a contact portion arranged so as to be capable of coming into contact with the lever means, and the setting of the chronograph hand by the setting mechanism is judged to have been released when there is a change in the contact relationship between the lever means and the contact portion.

3. A chronograph timepiece according to claim 2, wherein the lever means is equipped with a hammer operating second lever displaced in response to the operation to give a time measurement start instruction by the start/stop button in the reset state, and a hammer displaced in response to displacement of the hammer operating second lever and releasing the setting of the chronograph hand; and the setting releasing detection means judges the setting of the chronograph hand by the setting mechanism to have been released when there is a change in the contact relationship between the hammer and the contact portion.

4. A chronograph timepiece according to claim 3, wherein the setting releasing detection means judges the setting of the chronograph hand by the setting mechanism to have been released when the hammer and the contact portion are changed from a non-contact state to a contact state, or when the hammer and the contact portion are changed from the contact state to the non-contact state.

* * * * *